US005428913A

United States Patent [19]

Hillstrom

[11] Patent Number: 5,428,913

[45] Date of Patent: Jul. 4, 1995

[54] POLE BANNER SYSTEM

[75] Inventor: David U. Hillstrom, Novi, Mich.

[73] Assignee: Marketing Displays, Inc., Farmington Hills, Mich.

[21] Appl. No.: 184,301

[22] Filed: Jan. 21, 1994

[51] Int. Cl.[6] ..... G09F 7/00; G09F 7/06

[52] U.S. Cl. ..... 40/604; 40/606; 40/617

[58] Field of Search ..... 40/604, 603, 606, 607, 40/610; 248/231, 222.1, 221.3, 309, 225.1, 475.1; 403/380, 376

[56] References Cited

U.S. PATENT DOCUMENTS

| | | | |
|---|---|---|---|
| 3,301,518 | 1/1967 | Yetter et al. | 248/221.3 |
| 3,564,743 | 2/1971 | Gilmoure . | |
| 3,627,248 | 12/1971 | Nelson | 248/221.3 |
| 3,824,724 | 7/1974 | Miller et al. . | |
| 3,831,304 | 8/1974 | Miller et al. . | |
| 4,095,360 | 6/1978 | Dinan et al. . | |
| 4,284,840 | 8/1981 | Baker . | |
| 4,459,773 | 7/1984 | Sandlin et al. . | |
| 4,730,803 | 3/1988 | Hillstrom . | |
| 4,890,403 | 1/1990 | Dinan . | |
| 4,909,464 | 3/1990 | Levine et al. . | |
| 5,212,898 | 5/1993 | Dinan et al. . | |

*Primary Examiner*—Kenneth J. Dorner
*Assistant Examiner*—Cassandra Davis
*Attorney, Agent, or Firm*—Brooks & Kushman

[57] ABSTRACT

A bracket mounting system for mounting banners, posters and the like on posts, walls and other structures is disclosed. A pair of U-shaped channel brackets are fastened to the structure, such as by conventional fasteners or gear clamps. A banner with elongated tubular support members on each end is mounted in the brackets. A button or post in the support member or on the bracket mates with a corresponding opening in the other to hold the banner in the bracket.

24 Claims, 3 Drawing Sheets

POLE BANNER SYSTEM

TECHNICAL FIELD

The present invention relates to bracket mounting systems for mounting banners, posters and the like on posts, walls and other structures.

BACKGROUND ART

There are numerous systems known today for mounting banners, posters and the like on walls, poles and the like. Commercial establishments, such as service stations, restaurants, and retail outlets commonly use banners and large signs at their places of business to attract customers and notify passersby of certain specials or other notable matters.

Banners and posters preferably are relatively large in size in order to attract attention and present the applicable notice or display. Also, such devices preferably are inexpensive and relatively simple to assemble. Since advertising programs are changed frequently, the posters and banners should also be able to be changed relatively quickly and inexpensively, particularly by unskilled personnel.

The systems further should be durable and be secured rigidly to the building or pole so that they will not be damaged by inclement environmental conditions or be torn apart or become unfastened in high winds.

One type of known system for mounting banners is shown, for example, in U.S. Pat. No. 4,730,803 which is assigned to the same Assignee as the present invention.

It is an object of the present invention to provide an improved banner and poster mounting system. It is another object of the present invention to provide a banner and poster mounting system which is relatively inexpensive to manufacture and assemble, and is relatively easy to change or replace the banner or poster.

It is a further object of the invention to provide a banner and poster mounting system which has a minimum of parts and components. It is a still other object of the present invention to provide a banner and poster mounting system which can be used by unskilled personnel and provides a mounting structure which is relatively inconspicuous and does not detract from the building or pole when the banner or poster is not in place.

These and other objects, features and benefits of the present invention will become apparent from the following description, when taken in connection with the accompanying drawings and appended claims.

SUMMARY OF THE INVENTION

The present invention provides an improved banner or poster mounting system and apparatus. The system and apparatus is versatile and can be used for mounting a banner or poster on any available surface or structure, such as a wall, post, pole or the like.

A pair of elongated U-shaped channel brackets are mounted on the wall, pole or other structure in a spaced apart relationship in order to hang and mount a banner inbetween. Each of the brackets has a U-shaped channel section with a rear panel member and two adjacent panel members, one of which is preferably wider than the other for ease of mounting. The rear panel member of the bracket has at least one pair of openings in order to accommodate fastening means for connecting the bracket to the wall or pole. Preferably the openings are slots and the fastening means is a gear clamp which is secured around the pole or other structure. When the bracket is attached to a flat surface such as a wall or building, conventional fasteners, such as screws, are used to connect the bracket to the surface. It is also possible to provide two pairs of openings in the rear panel member of the bracket, one pair for mounting the bracket on a flat wall or other surface, and the other pair for mounting the bracket on a round pole or post.

A pair of angled flanges protrude from the rear panel of the bracket in order to help stabilize the bracket when it is mounted on a round surface, such as a pole. Also, an opening is provided in at least one of the adjacent panel members for mating with a detent button or post in order to securely hold the banner in place.

The elongated banner has sleeves or open hems on its two ends. Hollow tubular support members are positioned in each of the sleeves and are sized and dimensioned to fit within the U-shaped channels in the mounting brackets. The support tubes have an opening in each of them. Preferably, a spring biased detent member is positioned inside each of the tubular members with a detent button extending through an opening or hole in one side thereof. A corresponding opening or hole is also provided in the sleeve or hem of the banner to allow the detent button to protrude through it and mate with the bracket. The banner is mounted in the brackets by inserting the banner ends with the tubular support members into the U-shaped channels. The detent button is manually depressed to allow engagement and disengagement with the opening in the adjacent panel member.

Also, one of the two adjacent panel members of the U-shaped bracket is shorter than the other in order to provide ease of entry and exit of the banner and support member in the U-shaped channel. The longer of the two adjacent panel members also has an upwardly raised lip, partially for the same purpose and principally to assist in depressing the detent button as the support member is pushed into the bracket.

As an alternate embodiment, the button on the elongated support can be a fixed post and the corresponding adjacent panel member of the U-shaped bracket can have a flexible flap portion which accommodates entry of the post into the adjacent panel member opening thus securing the elongated support and banner in place. As another alternative, a fixed post can be provided on the flexible flap portion, the post mating with an opening in the elongated support in order to hold the banner in place.

DESCRIPTION OF THE PREFERRED EMBODIMENT

Figure 1:
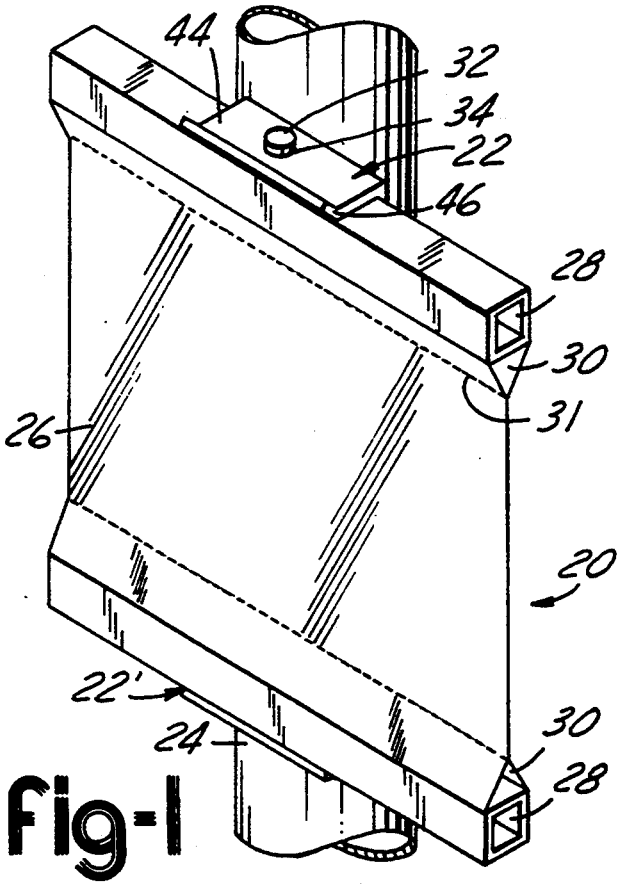
FIG. 1 is a perspective view illustrating the use of the present invention.

The present invention comprises an apparatus and system for mounting banners, posters and the like on various flat and curved surfaces and structures, such as walls and poles. One preferred embodiment of the present invention is shown in FIG. 1 and designated by the reference numeral 20. The invention comprises a pair of identical mounting brackets 22, 22′ positioned in a spaced apart manner on a pole 24. A banner 26 is mounted on the pole suspended inbetween the two brackets 22 and 22′. The banner is supported by a pair of hollow elongated tubular supports 28 which are positioned in sleeve members 30 in the upper and lower edges of the banner 26. The elongated supports 28 and thus the banner 26 is held in place in the brackets 22 and 22′ by raised projection members 32 which fit within openings 34 in the brackets 22.

A preferred embodiment of the bracket is shown in FIGS. 2–5. As shown, the bracket has an elongated U-shaped cross section with three elongated sides or panel members. The bracket 22 has an elongated rear panel member 40, a first elongated adjacent panel member 42 and a second elongated adjacent panel member 44. The side member 44 is shorter in width than side member 42 in order to facilitate ease of mounting of the banner, as described below. Similarly, the outer edge of side member 42 has an angled flanged rib 46 which also facilitates ease of mounting of the banner.

Each of the brackets 22, 22′ is preferably made from a metal material, such as 12 gauge steel, but can be made of any comparable material which has sufficient strength to accomplish the benefits and functions of the present invention. Also, in accordance with the present invention, the two mounting brackets 22 and 22′ used with the present system are the same. This provides a significant benefit in the cost of manufacture and the provision of parts for assembly of the system. In this regard, as shown in FIG. 1, the bracket 22 is positioned in the vertically uppermost portion of the banner mounting system with its upper side 42 and flanged rib 46 positioned above the banner 26. On the other hand, bracket 22′ mounted in the lowermost position on the wall or other surface and used to hold the lower edge of the banner, has its corresponding side 42 with the flanged rib 46 positioned in the most downward orientation.

Figure 14:
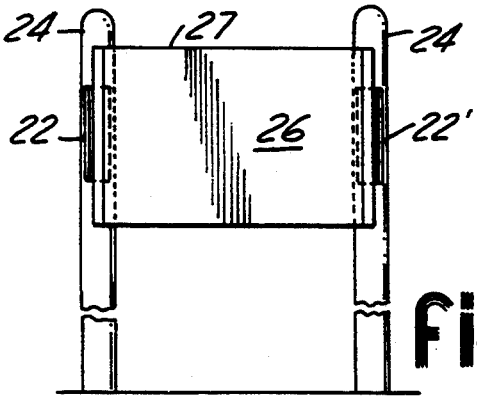
FIG. 14 illustrates the use of the present invention in a horizontal mounting arrangement.

It is also understood that the banner 26 could be mounted in a horizontal orientation on a wall surface or suspended between two poles or posts. This is illustrated in FIG. 14. The structure of the components and operation of the present invention would be the same. If the banner 26 is mounted with a horizontal orientation, it also may be necessary to add a support or stiffening member (not shown) along the upper edge 27 of the banner in order to prevent sagging.

Figure 2:
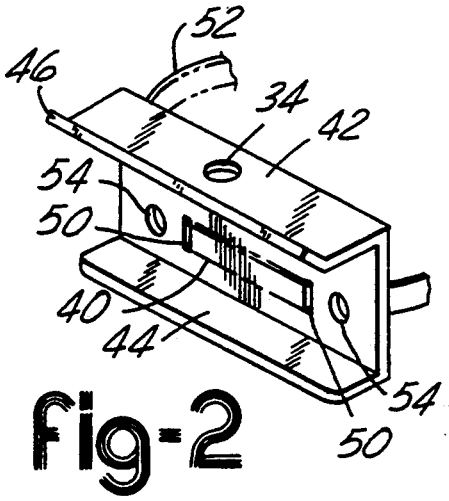
FIG. 2 is a perspective view of a U-shaped mounting bracket in accordance with the present invention.
Figure 7:
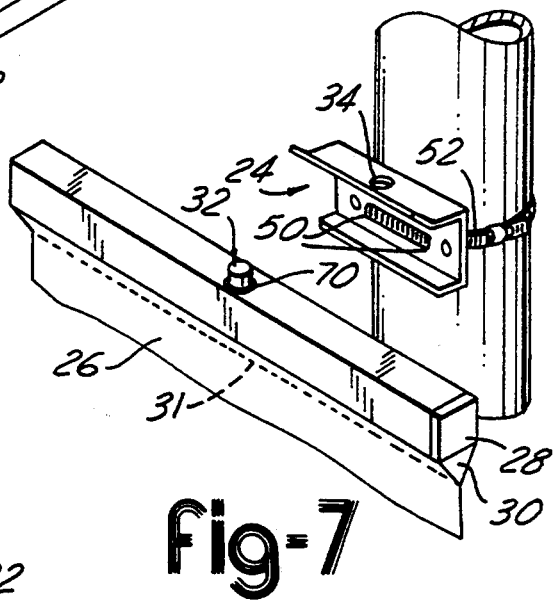
FIGS. 7 and 8 illustrate the use of the present invention in mounting a banner on a round pole.
Figure 9:
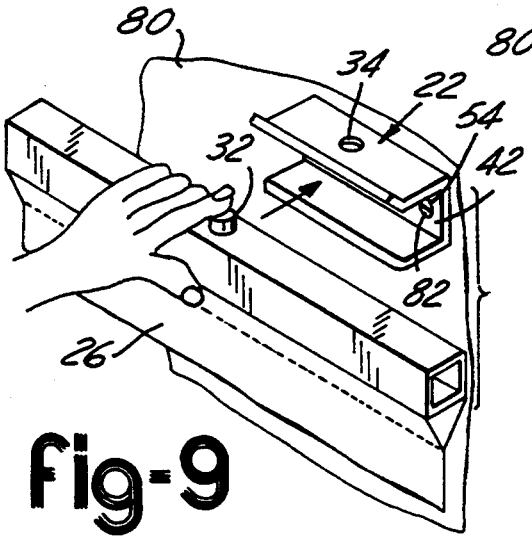
FIGS. 9 and 10 illustrate use of the present invention in mounting a banner on a wall or other flat surface.
Figure 10:
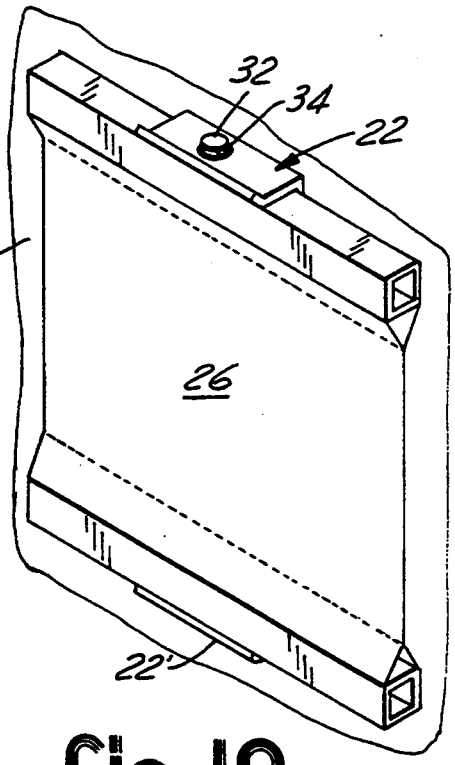
Figure 11:
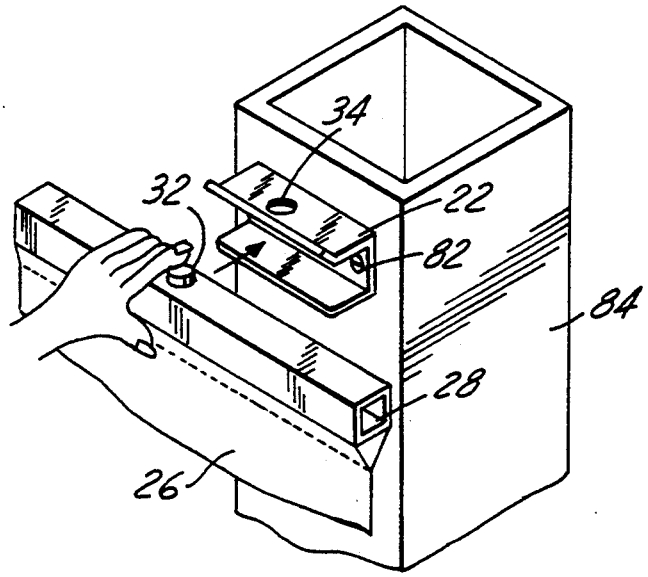
FIG. 11 illustrates use of the present invention in mounting a banner on a post with a square cross section.

The rear member 40 of the bracket 22 preferably has several openings therein. A pair of slots 50 are provided in order to facilitate use of a flexible strap and gear clamp mechanism 52, which is shown in FIGS. 2 and 7. In addition, a pair of circular mounting holes 54 are also provided in the rear member 40 in order to facilitate mounting of the bracket 22 on a wall or other flat surface (as shown in FIGS. 9–11). Although it is possible to provide the bracket 22 with either a pair of slotted openings 50 or a pair of mounting openings 54 for use in a particular application, it is preferred that both pairs of openings 50 and 54 are provided in the mounting brackets 22. This provides a more versatile apparatus and system that can be used with all types of surfaces and structures.

Figure 5:
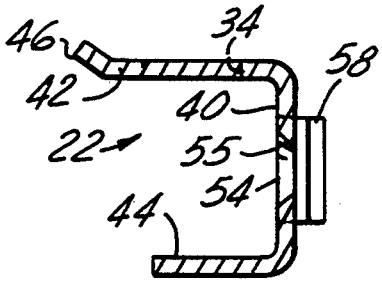
FIG. 5 is a cross-sectional view of the mounting bracket of FIG. 4, taken along lines 5—5 and in the direction of the arrows thereof.
Figure 4:
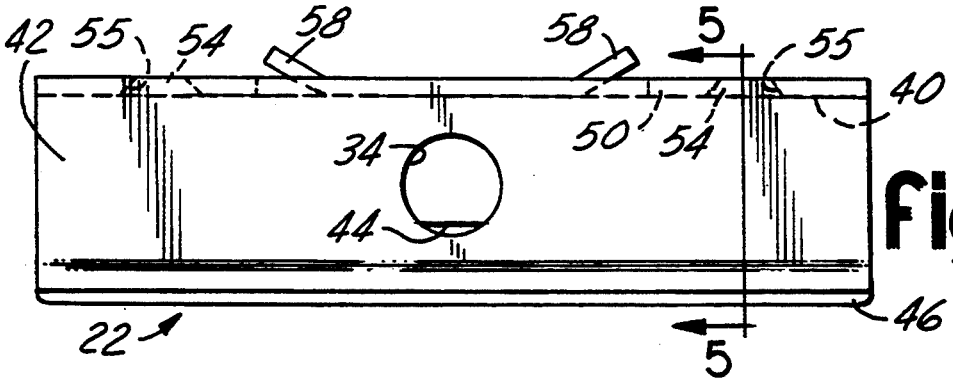
FIG. 4 is a top elevational view of the mounting bracket.
Figure 3:
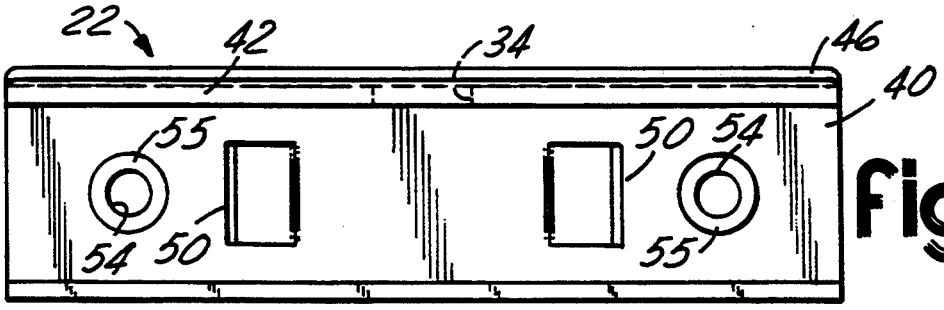
FIG. 3 is a front elevational view of the mounting bracket.

The openings 54 also preferably have angled conical surfaces 55 (as shown in FIGS. 3–5) in order to accommodate fasteners with a similar head shape. This allows the fasteners to be mounted flush against the rear member 40 and not interfere with the mounting of the banner in the bracket 22.

Figure 8:
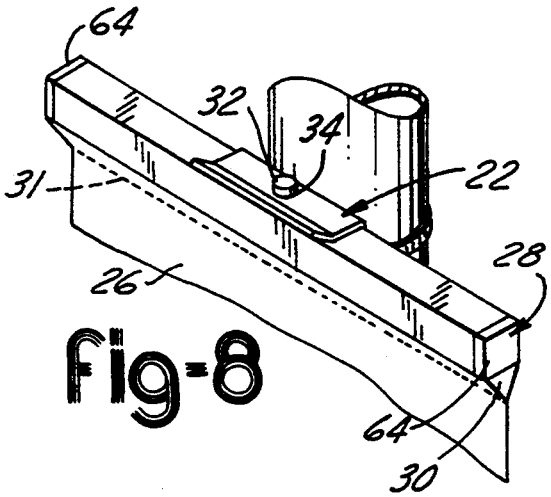

A pair of angled flange members 58 are provided in the rear member 40 of the bracket 22. Preferably, the flange members 58 are formed at the same time that the slots 50 are formed since they both can be formed with the same manufacturing procedure. The flanges 58 provide a more stable mounting system for mounting the bracket 22 on a curved or round surface, such as pole 24 (as shown in FIGS. 1 and 7–8).

Brackets 22 also include an opening 34 in the first elongated adjacent panel member 42. Opening 34 is provided to mate with a projecting detent button or fixed post on the banner mounting support member 28.

Figure 6:
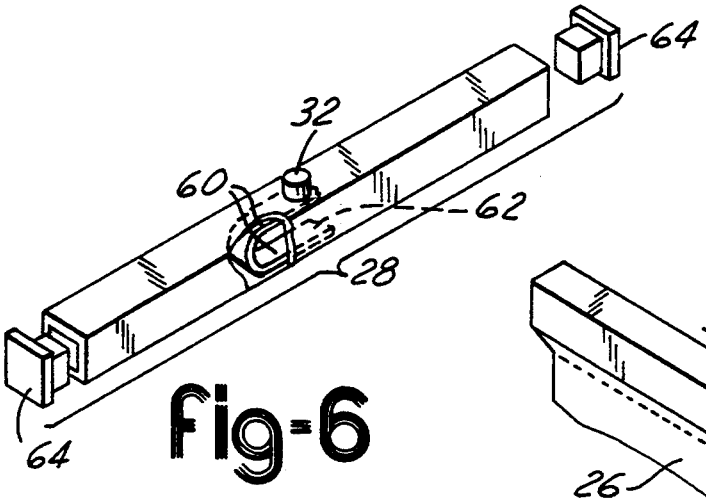
FIG. 6 is a exploded perspective view of the elongated banner support member.

The elongated banner mounting support member 28 is shown in more detail in FIG. 6. The support member 28 comprises an elongated hollow tubular member. Member 28 is preferably made from square 16-gauge steel tubing, although any other material of similar strength and durability could be utilized. Tubular support member 28 has an opening 60 in one surface. Preferably a detent button 32 is positioned inside the tubular member and protrudes through the opening 60. The detent button preferably is attached to a flat spring 62 which is bent, compressed and positioned in the support 28. Bias from the flat spring member 62 forces the detent button 32 through the opening 60. The force of the spring can be overcome by manually depressing the button 32 against the force of the spring. Also, the button 32 can be depressed automatically by pressure exerted against it by the angled flanged rib 46 when the support member 28 is pushed or inserted into the U-shaped channel of bracket 22. For this purpose, the top of button 32 can be rounded or ramped.

A pair of soft plastic or elastomeric end caps 64 preferably are provided on the ends of the support member 28. The end caps cover the cut ends of the tubular member and also provide a more aesthetic appearance for the apparatus.

The manner in which the system is used on a pole 24 of round cross section is shown in FIGS. 1 and 7–8. As shown, the upper bracket 22 is first secured to the pole 24 by use of the strap and gear clamp mechanism 52. The strap is inserted through the slotted openings 50 in the rear panel member of the bracket 22 and then wrapped around the pole 24 and secured in a conventional manner. A second identical bracket 22' is also secured to the pole 24 at a pre-specified distance vertically below the bracket 22. The pre-specified distance is determined by the height or length of the banner 26 and can be adjusted for banners of different heights by simply loosening one of the gear clamps 52 and repositioning the respective bracket 22 or 22'. The elongated supports 28 are then inserted within the hems or sleeves 30 on the upper and lower end edges of the banner 26. The detent button 32 protrudes through an opening 60 in the elongated support 28 as well as through openings 70 provided in the sleeves of the banner 26. The sleeves or hems on the banner 26 can be formed in any conventional manner, and typically are made when the banner material is folded over and heat staked, glued or otherwise secured to itself (along seam 31).

Preferably, the system is designed to provide adequate clearance between the U-shaped channels in the brackets 22, 22' and the elongated support members 28. This clearance allows space for the banner material which is mounted in the brackets along with the support members.

The banner 26 is then mounted in the pair of brackets 22, 22' positioned on the pole 24 in the manner shown in FIGS. 7 and 8. The detent button 32 is depressed (manually, automatically, or both) as the support members 28 are inserted in the U-shaped channels of the brackets 22. The elongated support 28 and banner 26 are secured in the brackets 22 when the detent button 32 "pops-up" through opening 34 in the bracket 22, thereby locking the banner in place on the pole 24. This provide a very quick and efficient system for mounting a banner on a pole.

In order to replace the banner, the banner is removed easily and quickly by simply depressing the detent button 32 and pulling the elongated supports 28 from the bracket 22. Thereafter, the supports 28 can be inserted in sleeves in another banner and the new banner can then be mounted in the brackets in the same manner. The banner can be made from any conventional material, such as vinyl, fabric, or coated paper. The advertisement or illustration on the banner can be virtually anything that is conventionally known today, and can be printed or photographically applied on the banner material.

As is evident, the present invention allows reuse of the support members 28 time after time with only the banners needed to be replaced or changed. The brackets also can be easily adjusted or repositioned on the pole in order to accommodate banners of different lengths. The present invention further allows change of the posters or banners without the use of any tools or hardware. It is also unnecessary to include directions. Once the brackets 22 are installed in place, the procedure for changing the banners is clear and only slight manual force is needed to take down and put up the banners.

FIGS. 9 and 10 illustrate use of the present invention on a wall or other flat surface 80. A pair of brackets 22, 22' are again positioned on the surface 80 at spaced apart locations corresponding to the length of the banner 26. The brackets 22 are secured to the wall or building surface by a pair of screws or other conventional fasteners 82 which are positioned through holes 54 in the rear member 42 of the brackets. (If necessary, screw anchors are first installed in the wall or other surface in order to hold the fasteners in place.)

Once the brackets 22 are mounted on the flat surface, the banner is mounted in the brackets in the same manner as described above. The elongated support members 28 are positioned in the sleeves 30 of the banner 26 and the detent buttons 32 are depressed until they snap into openings 34 in the brackets 22.

FIG. 11 illustrates the use of the present invention on a square pole 84. The installation and use of this system is similar to that described above with reference to FIGS. 9 and 10. The bracket 22 is mounted on one of the flat surfaces of the square pole 84 by use of a pair of screw-type fasteners 82 or any other conventional fasteners. Once the two brackets 22 are positioned in their predetermined spaced apart positioned, the detent buttons 32 are depressed and the banner 26 mounted in place.

With a square post or pole, it is also possible to mount the brackets 22 by use of straps and gear clamp mechanisms 52 in the same manner as that described above with respect to a round post or pole.

Figure 12:
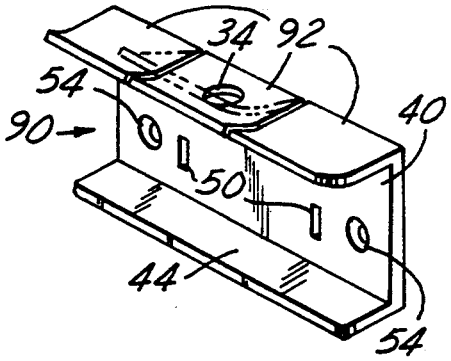
FIG. 12 illustrates an alternate embodiment of a mounting bracket in accordance with the present invention.

FIG. 12 illustrates an alternate embodiment of the bracket. In this embodiment, the bracket is generally referred to by the reference numeral 90. Bracket 90 has the same U-shaped channel as bracket 22 and has three connected panel members. The panel members 40 and 44 are identical to the corresponding members of bracket 22 and are designated by the same reference numerals. The upper adjacent panel member designated by the numeral 92 has a pair of slits 94 which separate a flexible movable flap 96 in side member 92. Opening 34 is positioned on the flap 96.

The bracket 90 of FIG. 12 can be used when a fixed post or projection 32 is utilized on the elongated support 28, rather than a spring biased detent mechanism. In order to provide the requisite clearance for the stationary post 32 to be inserted in hole 34 in bracket 90, the flap 96 is adapted to be bent such that the banner 26 and support member 28 can be inserted in the U-shaped channel and the post 32 positioned in the opening 34. Removal of the banner 26 from bracket 90 is simply a reversal of that procedure, namely, the flap or tab 96 is manually moved or bent upwardly, facilitating removal of the post 32, and elongated support and banner from the bracket.

Figure 13:
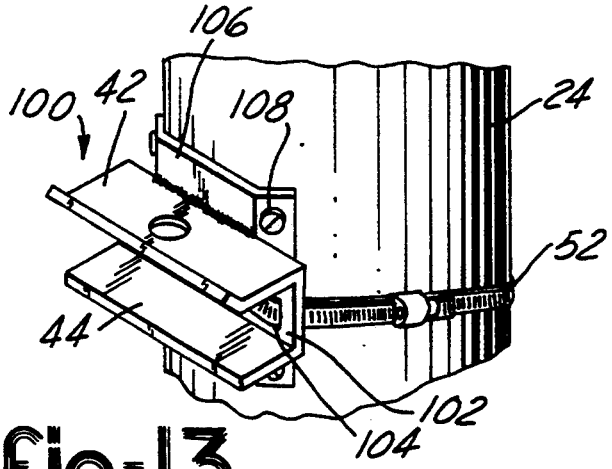
FIG. 13 illustrates another embodiment of a mounting bracket in accordance with the present invention.

FIG. 13 shows still another alternate embodiment of the bracket for use with the present invention. The bracket in this embodiment is generally indicated by the numeral 100. In this embodiment, the elongated adjacent panel members 42 and 44 are the same as the corresponding panel members of bracket 22, but the rear member 102 has been changed. In particular, slots 104 in the rear member 102 are positioned near the outer edges of the elongated bracket 100 (as shown in FIG. 13). The slots 104 are used for insertion of a strap and gear clamp fastener 52. Also, a second member 106 is securely attached, such as by welding, to the rear member 102 of the bracket 100. The member 106 is shaped as shown in FIG. 13 and is used to stabilize and securely mount the bracket 100 to a rounded pole 24 or other curved surface. The bracket member 106 can also be secured to the pole by a number of conventional fasteners 108 through appropriate openings or holes provided in bracket 106 for that purpose.

Bracket 100 is particularly provided only for a rounded surface or cross section and provides a more stable and secure fixture for the bracket on such a structure.

Figure 15:
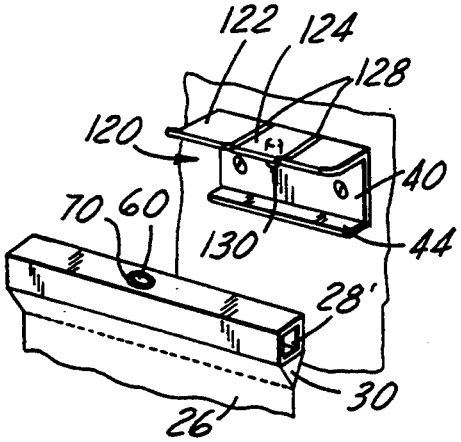
FIG. 15 illustrates still another embodiment of a mounting bracket in accordance with the present invention.

A still further embodiment of the invention is shown in FIG. 15. The bracket 120 is mounted on a pole, wall or other surface 122 in any of the various manners discussed above. Rear and adjacent panel members 40 and 44 are the same as those described above with reference to brackets 22 and 22'. The other adjacent panel member 124 has a flap member 126 separated by slots 128. A fixed post or nub 130 is positioned on the flap 126. The banner 26 has an elongated support member 28' mounted in sleeve 30. The support member 28' has an opening 60 and does not have a detent button or the like. Instead, when the banner 26 and support member 28' are inserted in the bracket 120, the post 130 on flap 126 mates with opening 60. Removal of the banner from surface 122 is the reverse of that procedure, namely flap 126 is manually raised sufficiently to allow post 130 and opening 60 to become disengaged, thereby allowing banner 26 to be removed from bracket 120. Banner 26 can have an opening 70 in the sleeve in order to allow post 130 and opening 60 to be mated more easily, although it is possible not to provide an opening at all in the banner.

Although particular embodiments of the present invention have been illustrated in the accompanying drawings and described in the foregoing detailed description, it is to be understood that the present invention is not to be limited to just the embodiments disclosed, but that they are capable of numerous rearrangements, modifications and substitutions without departing from the scope of the claims hereafter.

It is claimed:

1. A bracket for mounting a display on a surface, said bracket having substantially a U-shaped cross section and comprising a first elongated rear panel member with at least a pair of openings therein, a second elongated adjacent panel member with at least one opening therein, a third elongated adjacent panel member, and flange members on said first elongated rear panel member adjacent said pair of openings, said flanges protruding outwardly at an angle from said rear panel member in opposite directions toward the lateral ends of said bracket and providing stabilizing means for assisting mounting of said bracket on said surface by fasteners.

2. The bracket of claim 1 further comprising a gear clamp and strap for connecting said bracket to said surface, said strap being positioned through said pair of openings.

3. The bracket of claim 1 further comprising a second pair of openings in said first elongated rear panel member to facilitate fastening of said bracket to said surface.

4. The bracket of claim 1 wherein said third elongated adjacent panel member has a width less than the width of said second elongated adjacent panel member in order to facilitate mounting of said display in said U-shaped bracket.

5. The bracket of claim 1 further comprising an elongated flanged rib on said second elongated adjacent panel member.

6. The bracket of claim 1 wherein said opening in said second elongated adjacent panel member is centrally positioned thereon.

7. An apparatus for mounting a display on a surface comprising:

an elongated bracket having substantially a U-shaped cross section, said bracket having a first elongated rear panel member and a pair of adjacent panel members, said rear panel member having a first pair of openings therein and a pair of flanges adjacent said first pair of openings, and strap means for connecting said bracket to said surface, said strap means being positioned through said first pair of openings, whereby said flanges protrude outwardly beyond a rear surface of said rear member to provide stabilizing means for assisting mounting of said bracket on said surface.

8. An apparatus for mounting a banner on a surface comprising:

an elongated bracket with a rear panel member and two adjacent panel members forming a U-shaped channel, said rear panel member having first openings for mounting said bracket on said surface, and a first of said adjacent panel members having an opening therein, fastening means for securing said bracket to said surface, an elongated support, a banner connected to said elongated support, protruding means on said support for mounting said banner and said support in said U-shaped channel, said protruding means positioned to mate with said opening in said first of said adjacent panel members in order to securely hold said support and said banner in said bracket.

9. The apparatus of claim 8 wherein said fastening means comprises a strap and said strap is positioned through said first openings in said rear panel member.

10. The apparatus of claim 8 further comprising second openings in said rear panel member to facilitate mounting of said bracket to said surface by said fastening means.

11. The apparatus of claim 8 wherein said banner has an elongated sleeve at one end, and said elongated support is positioned in said elongated sleeve.

12. The apparatus of claim 8 wherein said two adjacent panel members have different widths in order to facilitate mounting of said banner and elongated support in said U-shaped channel.

13. The apparatus of claim 8 wherein said protruding means comprises a biased detent member.

14. The apparatus of claim 8 wherein said protruding means comprises a stationary post.

15. The apparatus of claim 7 further comprising a second pair of openings in said rear panel member adjacent said first pair of openings.

16. The apparatus of claim 7 wherein said first pair of openings comprises a pair of slots.

17. A banner mounting system comprising:

a pair of elongated U-shaped brackets, each of said brackets having a substantially U-shaped cross-section, a first elongated rear panel member with a first pair of openings therein, a second elongated adjacent panel member with at least one opening therein, and a third elongated adjacent panel member, fastening means for securing each of said brackets to a surface, a banner having two side edges and two end edges, a pair of elongated supports for said banner, said supports being connected to said banner at its two end edges, and raised projection means in each of said elongated supports for mounting said supports in said U-shaped brackets, said projection means positioned to mate with said openings in said second elongated adjacent panel members in order to secure said support and said banner to said brackets.

18. The banner mounting system of claim 17 wherein said fastening means comprises a strap and said strap is positioned through said first pair of openings in said rear panel member.

19. The banner mounting system of claim 17 further comprising a second pair of openings in said rear panel member to facilitate fastening of said brackets to said surface by said fastening means.

20. The banner mounting system of claim 17 wherein said banner has sleeve means on said two end edges, and said elongated supports are positioned in said sleeve means.

21. The banner mounting system of claim 17 wherein said elongated supports are hollow tubular members with at least one opening therein, and said projection means comprises biased detent means positioned inside said tubular members and having detent buttons which protrude though said openings.

22. The banner mounting system of claim 17 wherein said brackets are secured to a surface by said fastening means in a vertically spaced apart manner, and said banner is mounted between said brackets.

23. The banner mounting system of claim 17 wherein said third elongated adjacent panel member has a width dimension less than said second elongated adjacent panel member in order to facilitate ease of mounting of said banner in said bracket.

24. The banner mounting system of claim 17 wherein said brackets are secured to a surface by said fastening means in a horizontally spaced apart manner, and said banner is mounted between said brackets.

* * * * *